US011009044B2

(12) United States Patent
Sakaguchi et al.

(10) Patent No.: US 11,009,044 B2
(45) Date of Patent: May 18, 2021

(54) OUTLET PORT PART AND VACUUM PUMP

(71) Applicant: Edwards Japan Limited, Yachiyo (JP)

(72) Inventors: Yoshiyuki Sakaguchi, Yachiyo (JP); Norihiro Kurokawa, Yachiyo (JP)

(73) Assignee: Edwards Japan Limited, Chiba (JP)

( * ) Notice: Subject to any disclaimer, the term of this patent is extended or adjusted under 35 U.S.C. 154(b) by 498 days.

(21) Appl. No.: 15/129,266

(22) PCT Filed: Feb. 27, 2015

(86) PCT No.: PCT/JP2015/055825
§ 371 (c)(1),
(2) Date: Sep. 26, 2016

(87) PCT Pub. No.: WO2015/151679
PCT Pub. Date: Oct. 8, 2015

(65) Prior Publication Data

US 2017/0108008 A1 Apr. 20, 2017

(30) Foreign Application Priority Data

Mar. 31, 2014 (JP) ..... JP2014-072133

(51) Int. Cl.
*F04D 29/58* (2006.01)
*F04D 19/04* (2006.01)
(Continued)

(52) U.S. Cl.
CPC ..... *F04D 29/5853* (2013.01); *F04D 19/042* (2013.01); *F04D 29/023* (2013.01);
(Continued)

(58) Field of Classification Search
CPC ..... F05B 2260/231; F05B 2280/5004
See application file for complete search history.

(56) References Cited

U.S. PATENT DOCUMENTS 5,350,275 A * 9/1994 Ishimaru ..... F04D 19/042 415/200
5,422,081 A * 6/1995 Miyagi ..... B01D 8/00 422/170
(Continued)

FOREIGN PATENT DOCUMENTS

JP S6419198 A 1/1989
JP H06159287 A 6/1994
(Continued)

OTHER PUBLICATIONS

International Search Report dated Jun. 2, 2015 for corresponding PCT Application No. PCT/JP2015/055825.
(Continued)

*Primary Examiner* — Justin D Seabe
*Assistant Examiner* — Jason G Davis
(74) *Attorney, Agent, or Firm* — Theodore M. Magee; Westman, Champlin & Koehler, P.A.

(57) ABSTRACT

An outlet port part has a heat insulating portion for preventing heat obtained from a heater disposed in the outlet port part from being transmitted toward a base side, and for transmitting the heat efficiently to the back (the vacuum pump side) of the outlet port. The heat insulating portion of the outlet port part is provided with a flange portion formed on the outer peripheral surface of the outlet port part, and a heat insulating spacer disposed in close contact with the flange portion. Alternatively, an outlet port part flange portion that is configured by integrating the flange portion formed on the outer peripheral surface of the outlet port part and the foregoing heat insulating spacer functions as the heat insulating portion. This configuration can efficiently increase the temperature of the entire outlet port of the vacuum pump, thereby reducing the amount of product and deposit.

4 Claims, 6 Drawing Sheets

(51) Int. Cl.
*F04D 29/52* (2006.01)
*F04D 29/02* (2006.01)

(52) U.S. Cl.
CPC ..... *F04D 29/522* (2013.01); *F04D 29/584* (2013.01); *F05D 2250/52* (2013.01); *F05D 2260/231* (2013.01); *F05D 2260/607* (2013.01)

(56) References Cited

U.S. PATENT DOCUMENTS

| | | | | |
|---|---|---|---|---|
| 5,618,167 | A * | 4/1997 | Hirakawa | F04D 19/04 417/372 |
| 5,924,841 | A | 7/1999 | Okamura et al. | |
| 8,894,355 | B2 * | 11/2014 | Sekita | F04D 29/701 415/121.2 |
| 2015/0275914 | A1 * | 10/2015 | Tsutsui | F04D 17/08 415/177 |

FOREIGN PATENT DOCUMENTS

| | | | |
|---|---|---|---|
| JP | H09310696 | A | 12/1997 |
| JP | H11201083 | A | 7/1999 |
| JP | 2000064986 | A | 3/2000 |

OTHER PUBLICATIONS

International Written Opinion dated Jun. 2, 2015 for corresponding PCT Application No. PCT/JP2015/055825.
Communication dated Oct. 19, 2017 and Supplementary European Search Report dated Oct. 12, 2017 for corresponding European Application No. EP15772176.

* cited by examiner

OUTLET PORT PART AND VACUUM PUMP

CROSS-REFERENCE TO RELATED APPLICATION

This Application is a Section 371 National Stage Application of International Application No. PCT/JP2015/055825, filed Feb. 27, 2015, which is incorporated by reference in its entirety and published as WO 2015/151679 A1 on Oct. 8, 2015 and which claims priority of Japanese Application No. 2014-072133, filed Mar. 31, 2014.

BACKGROUND OF THE INVENTION

1. Field of the Invention

The present invention relates to an outlet port part and a vacuum pump. More specifically, the present invention relates to an outlet port part for reducing the amount of product and deposit, and a vacuum pump.

2. Description of the Related Art

A device for carrying out film deposition as one of the steps for manufacturing a semiconductor, a solar cell, a liquid crystal and the like uses process gas such as silane gas ($SiH_4$) in a vacuum chamber for producing a Si film.

When the device provided with a vacuum pump uses such process gas, the exhaust gas resulting from the use of the process gas is discharged to the outside from a reactor of the vacuum pump that is connected to a vacuum chamber, which is a semiconductor manufacturing device. Solid matters and particulate matters produced due to such exhaust gas being cooled to a sublimation temperature or lower are prone to accumulate on the outlet side of the vacuum pump.

Regular maintenance (overhaul) is a necessary procedure in order to remove the accumulated products, and typically the maintenance needs to be carried out approximately every three months. From an operation and cost perspective, however, the longer the interval between one maintenance and the other (free maintenance period), the better.

A technique for wrapping a heater around the outside of a vacuum pump is known as a technique for preventing the accumulation of reaction products in the vacuum pump.

Japanese Patent Application Laid-open No. 2000-064986 describes a technique for devising a structure for the stator blades of a turbomolecular pump in order to cool the rotor blades when sucking an active gas. Reaction products that are generated at or below the sublimation temperature of the active gas could solidify and adhere to the inside of the pump, closing the gaps between the rotor blades and the stator blades. Japanese Patent Application Laid-open No. 2000-064986 describes that, in order to prevent the rotor blades and the stator blades from coming into contact with each other, a heater is wrapped around the outside of the pump so that the internal temperature of the pump does not fall below a certain temperature.

The discussion above is merely provided for general background information and is not intended to be used as an aid in determining the scope of the claimed subject matter. The claimed subject matter is not limited to implementations that solve any or all disadvantages noted in the background.

SUMMARY OF THE INVENTION

As described in Japanese Patent Application Laid-open No. 2000-064986, a conventional vacuum pump has an exhaust gas passage (outlet port 11) at a base section (base portion 10), wherein a replaceable outlet port part is inserted into the outlet port. The outlet port part is attached to the base of the vacuum pump and a flange surface of the outlet port part comes into direct contact with the base of the vacuum pump.

In the foregoing structure, i.e., the structure in which the part inserted into the outlet port (the outlet port part) is attached directly to the base, the temperatures of the outlet port and the outlet port part drop easily due to the influence of the temperature of the base, the foreline piping, or the atmosphere in the environment where these temperatures are lower than those of the outlet port and the outlet port part. For this reason, products of the abovementioned process gas accumulate easily.

In preventing the accumulation of products by increasing the temperatures of the outlet port and the outlet port part, the temperatures of the outlet port and the outlet port part are increased so (heated) by wrapping a heater around the outside (the atmosphere side) of the outlet port into a cylinder to transmit the heat to the inside of the outlet port.

Unfortunately, the heating effect is limited to the periphery of the heater, making it difficult to efficiently increase the temperature of the entire outlet port or a desired section thereof.

An object of the present invention is to provide an outlet port part capable of reducing the amount of product and deposit by efficiently increasing the temperature of the entire outlet port of a vacuum pump in which the outlet port part is disposed, and the vacuum pump provided with this outlet port part.

In order to achieve the foregoing object, an invention according to claim 1 is an outlet port part that is provided with a housing portion partially inserted into an outlet port of a vacuum pump, and a flange portion formed on an outer peripheral surface of the housing portion, the outlet port part including a heat insulating means.

An invention according to claim 2 provides the outlet port part according to claim 1, wherein the heat insulating means is provided in a fixed manner on the flange portion.

An invention according to claim 3 provides the outlet port part described in claim 1 or 2, wherein the heat insulating means is manufactured from a material having thermal conductivity lower than that of the housing portion.

An invention according to claim 4 provides the outlet port part described in claim 1, 2 or 3, wherein the heat insulating means is manufactured from stainless steel.

An invention according to claim 5 provides the outlet port part described in any one of claims 1 to 4, wherein a non-contact portion is formed on a contact surface where the heat insulating means comes into contact with at least either the flange portion or a base of the vacuum pump, in order to reduce the area of the contact surface.

An invention according to claim 6 provides the outlet port part described in any one of claims 1 to 5, wherein the flange portion and the heat insulating means are joined to each other via an O-ring.

An invention according to claim 7 provides the outlet port part described in claim 1, wherein the housing portion and the heat insulating means are each configured by one component.

An invention according to claim 8 provides the outlet port part described in claim 1, wherein the heat insulating means is configured by making a longitudinal width of the flange portion at least three times the thickness of an inner peripheral wall of the housing portion.

An invention according to claim 9 provides a vacuum pump, having: a casing in which are formed an inlet port and an outlet port that is provided with the outlet port part described in any one of claims 1 to 8; a rotating shaft contained in the casing and rotatably supported; a rotating body fixed to the rotating shaft; a rotor blade provided radially from an outer peripheral surface of the rotating body; a stator blade disposed at a predetermined interval from the rotor blade; and a gas transfer mechanism for transferring a gas sucked from the inlet port, to the outlet port by an interaction between the rotor blade and the stator blade.

The present invention can provide an outlet port part capable of reducing the amount of product and deposit by efficiently increasing the temperature of the entire outlet port of a vacuum pump in which the outlet port part is disposed, and the vacuum pump provided with this outlet port part.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DESCRIPTION OF THE PREFERRED EMBODIMENT

(i) Summary of Embodiment

An outlet port part according to an embodiment of the present invention has a heat insulating portion (heat insulating means) for efficiently transmitting heat obtained from a heater disposed in the outlet port part to the back (a vacuum pump side) of an outlet port. A vacuum pump according to the embodiment of the present invention has the outlet port part having the heat insulating portion (heat insulating means).

The heat insulating portion of the outlet port part according to the present embodiment has a ring-shaped flange portion formed on an outer peripheral surface of a housing section of the outlet port part and a heat insulating spacer disposed in close contact with the flange portion.

Alternatively, a flange portion of the outlet port part that is configured by integrating the flange portion formed on the outer peripheral surface of the outlet port part and the foregoing heat insulating spacer functions as a heat insulating portion.

According to this configuration, the amount of product and deposit can be reduced by efficiently increasing the temperature of the entire outlet port of the vacuum pump.

(ii) Detail of Embodiment

Configuration of Vacuum Pump

A preferred embodiment of the present invention is described hereinafter in detail with reference to FIGS. 1 to 6.

Figure 1:
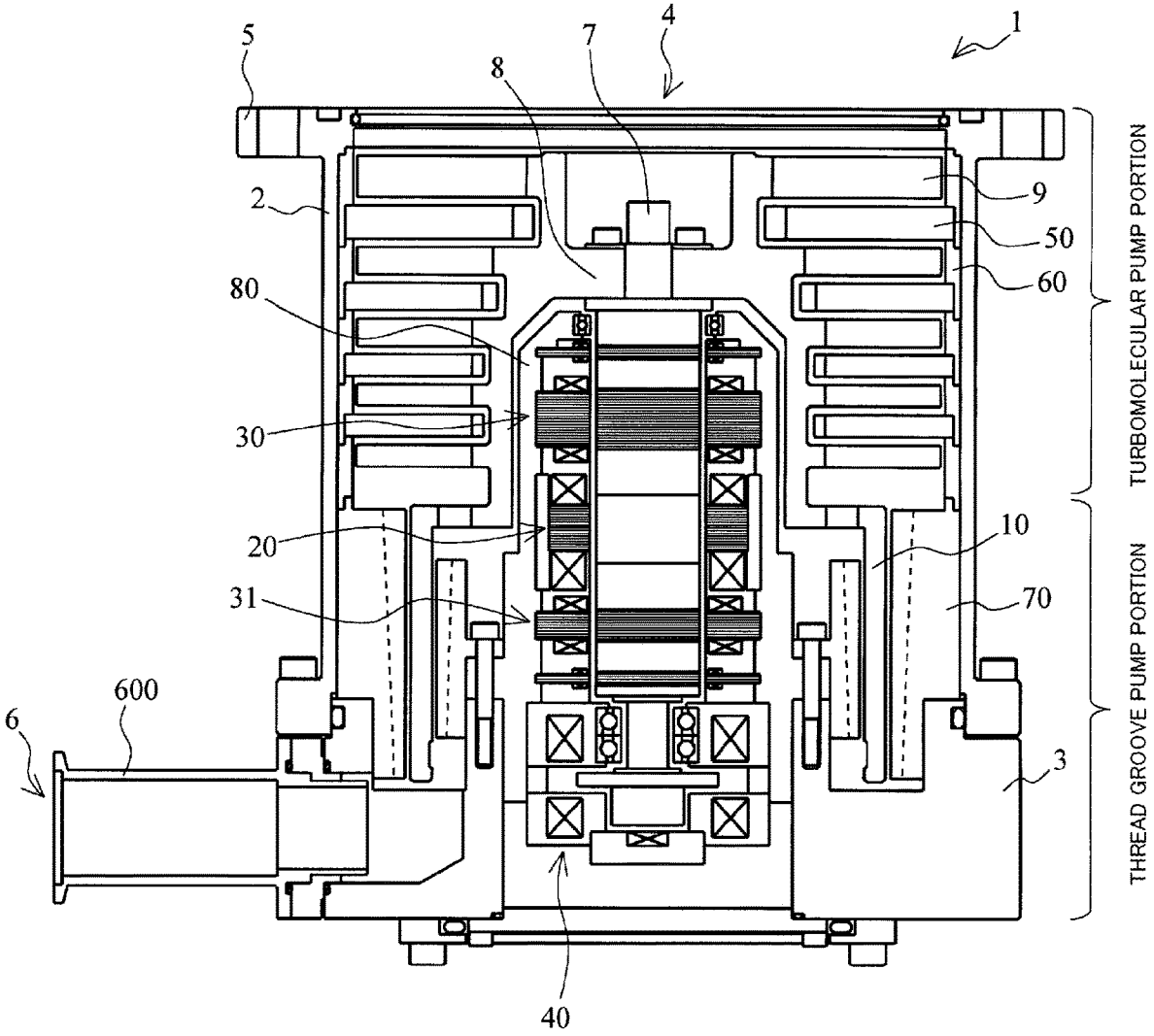
FIG. 1 is a diagram showing a schematic configuration example of a vacuum pump having an outlet port part according to an embodiment of the present invention.

FIG. 1 is a diagram of the first schematic configuration example of a vacuum pump (turbomolecular pump 1) according to an embodiment of the present invention, showing a cross-sectional diagram taken along an axial direction of the turbomolecular pump 1.

Note in the embodiment of the present invention that, for convenience, the diametrical direction of rotor blades is described as "diameter (diameter/radius)," and the direction perpendicular to the diametrical direction of the rotor blades as "axial direction."

A casing 2 forming a casing of the turbomolecular pump 1 is in the shape of a rough cylinder and configures a housing of the turbomolecular pump 1 along with a base 3 provided at a lower portion of the casing 2 (on the outlet port 6 side). A gas transfer mechanism, a structure that brings out the exhaust function of the turbomolecular pump 1, is stored inside this housing.

This gas transfer mechanism is configured mainly by a rotary portion (rotor portion) rotatably supported (axially supported) and a fixed portion fixed to the housing.

Although not shown, a controller for controlling the operations of the turbomolecular pump 1 is connected to the outside of the casing of the turbomolecular pump 1 by a dedicated line.

An inlet port 4 for introducing a gas into the turbomolecular pump 1 is formed at an end portion of the casing 2. A flange portion 5 bulging toward the outer periphery is formed on an end surface of the casing 2 at the inlet port 4 side.

An outlet port 6 for discharging the gas from the turbomolecular pump 1 is provided at the base 3.

In the present embodiment, an outlet port part 600 with a heat insulating portion is inserted into the outlet port 6 provided in the base 3. With this outlet port part 600 inserted into the outlet port 6, the mouth of the outlet port part 600 on the atmosphere side (the exhaust side) functions as the outlet port 6. The outlet port part 600 is described hereinafter in detail.

The rotary portion has a shaft 7 functioning as a rotating shaft, a rotor 8 disposed in the shaft 7, a plurality of rotor blades 9 provided in the rotor 8, and a rotor cylindrical portion 10 provided on the outlet port 6 side (thread groove pump portion). The shaft 7 and the rotor 8 configure the rotor portion.

Each of the rotor blades 9 is configured using a disc-shaped member that extends radially in the direction perpendicular to the axis of the shaft 7.

The rotor cylindrical portion 10 is configured using a cylindrical member concentric with the rotation axis of the rotor 8.

A motor portion 20 for rotating the shaft 7 at high speed is provided in the middle of the axial direction of the shaft 7 and contained in a stator column 80.

In addition, radial magnetic bearing devices 30, 31 for supporting (axially supporting) the shaft 7 in a radial direction in a non-contact manner are provided on the inlet port 4 side and the outlet port 6 side of the motor portion 20 of the shaft 7. An axial magnetic bearing device 40 for supporting the shaft 7 in the axial direction in a non-contact manner is provided at the lower end of the shaft 7.

A fixed portion (stator portion) is formed on the inner peripheral side of the housing. This fixed portion is configured by a plurality of stator blades 50 provided on the inlet port 4 side (turbomolecular pump portion) and a thread groove spacer 70 provided on an inner peripheral surface of the casing 2.

Each of the stator blades 50 is configured using a disc-shaped member that extends radially in the direction perpendicular to the axis of the shaft 7.

Each stage of stator blades 50 is fixed with a cylindrical stator blade spacer 60 therebetween.

In the turbomolecular pump portion, the stator blades 50 and the rotor blades 9 are disposed in alternate layers to configure a plurality of stages in the axial direction, but any number of rotor parts and (or) stator parts may be provided as needed in order to fulfill discharging performance (exhaust performance) required in the vacuum pump.

The thread groove spacer 70 has a spiral groove that is formed to face the rotor cylindrical portion 10.

The thread groove spacer 70 faces an outer peripheral surface of the rotor cylindrical portion 10 with a predetermined clearance therebetween. When the rotor cylindrical portion 10 rotates at high speed, the gas compressed in the turbomolecular pump 1 is fed toward the outlet port 6 while being guided along the thread groove (the spiral groove) as the rotor cylindrical portion 10 rotates. Specifically, the spiral groove functions as a flow path for transporting the gas. The gas transfer mechanism for transferring the gas along the thread groove is configured by placing the thread groove spacer 70 and the rotor cylindrical portion 10 to face each other with the predetermined clearance therebetween.

The smaller the clearance, the better, to reduce the force of the gas flowing backward toward the inlet port 4.

The direction of the spiral groove formed in the thread groove spacer 70 is directed toward the outlet port 6 when the gas is transported along the spiral groove in the direction of rotation of the rotor 8.

The depth of the spiral groove becomes narrow toward the outlet port 6 so that the gas to be transported along the spiral groove is compressed more toward the outlet port 6. The gas sucked from the inlet port 4 is compressed in the turbomolecular pump portion, further compressed in the thread groove pump portion, and then discharged from the outlet port 6.

The turbomolecular pump 1 configured as described above performs evacuation processing of a vacuum chamber (not shown) disposed in the turbomolecular pump 1.

As described above, the outlet port of the turbomolecular pump 1 according to the embodiment of the present invention is provided with the outlet port part 600 for the pump.

Figure 2:
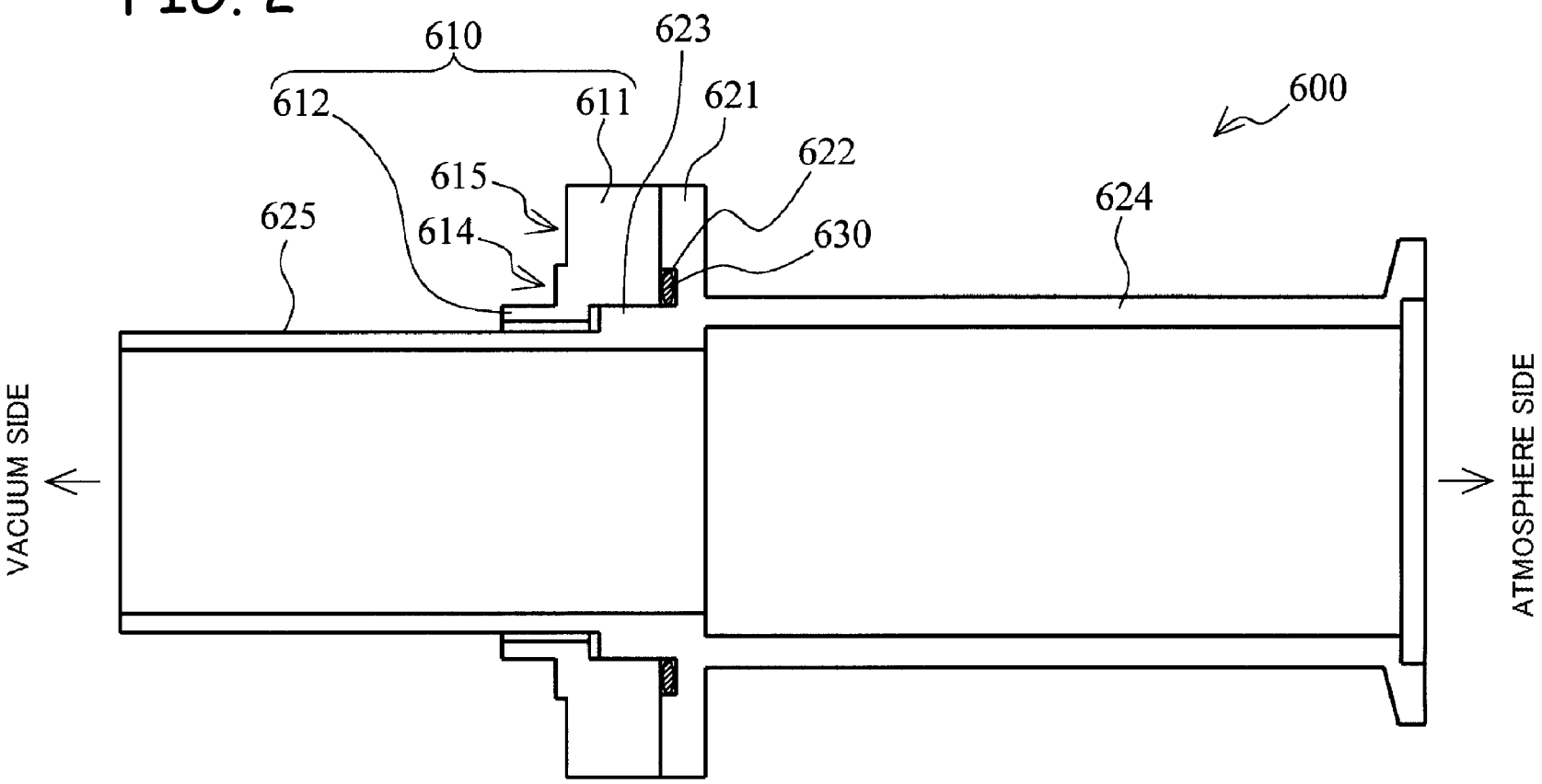
FIG. 2 is a diagram showing a schematic configuration example of the outlet port part according to the embodiment of the present invention.

FIG. 2 is a cross-sectional diagram showing a schematic configuration example of the outlet port part 600 with a heat insulating spacer 610 according to the embodiment of the present invention.

Figure 3:
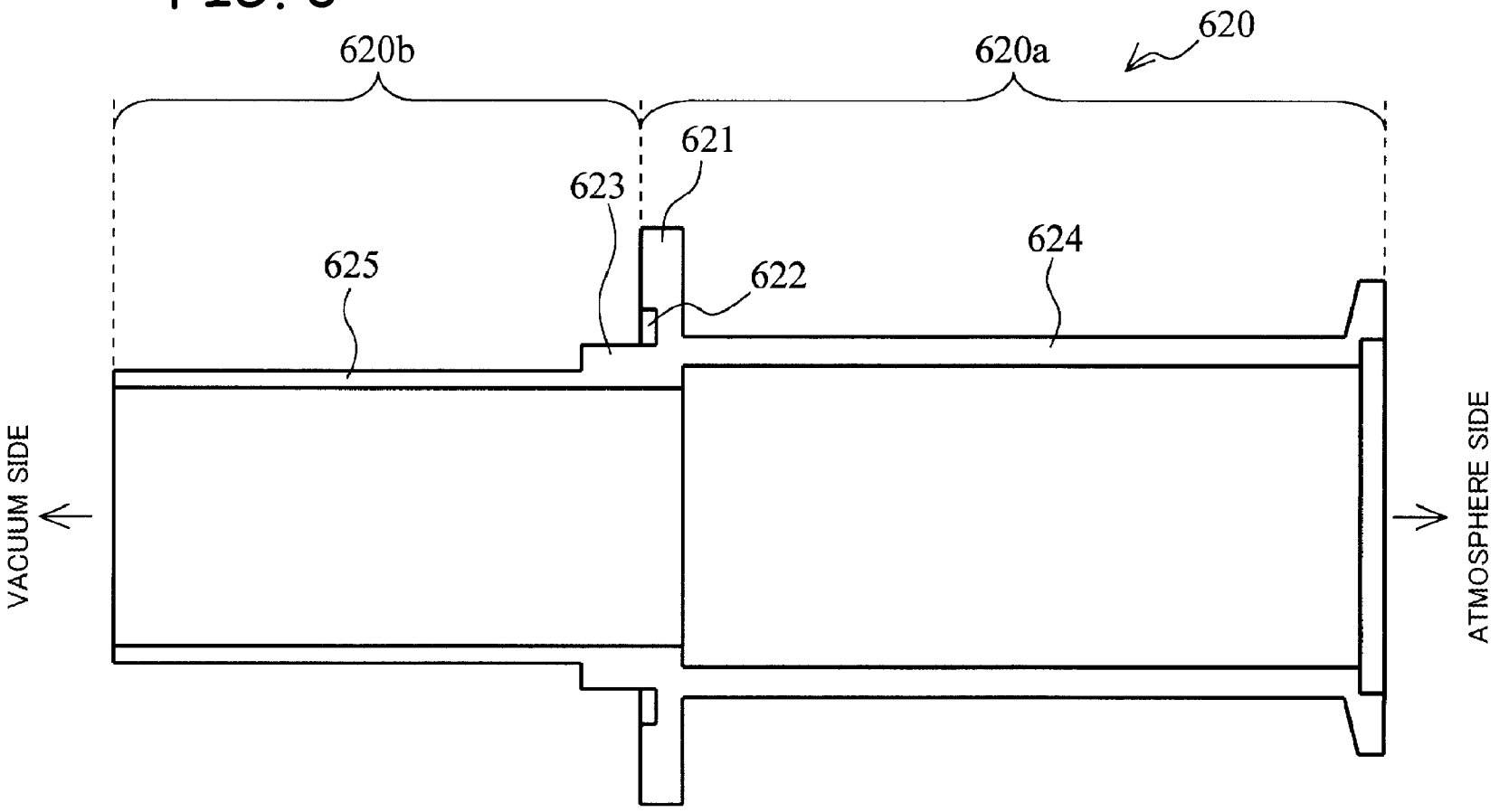
FIG. 3 is a diagram for explaining the outlet port part according to the embodiment of the present invention.

FIG. 3 is a cross-sectional diagram for explaining an outlet port part 620 according to the embodiment of the present invention.

Figure 4B:
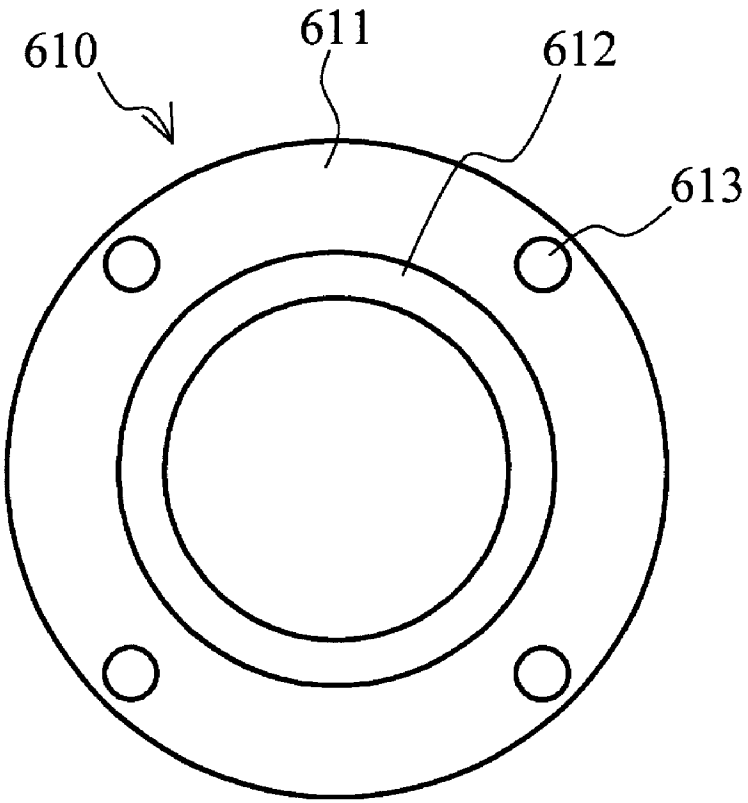
FIGS. 4A and 4B are diagrams for explaining a heat insulating spacer according to the embodiment of the present invention.
Figure 4A:
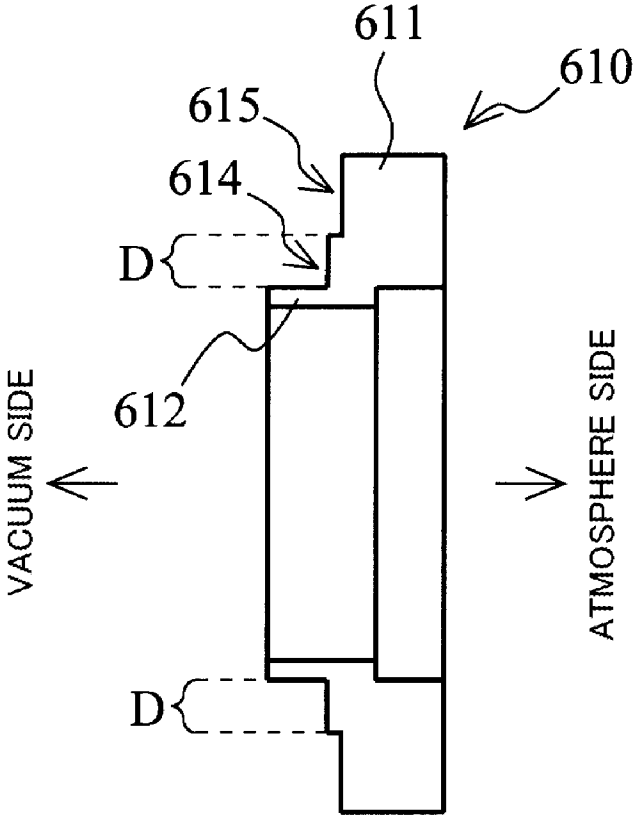

FIGS. 4A and 4B are diagrams for explaining the heat insulating spacer 610 according to the embodiment of the present invention.

As shown in FIG. 2, the outlet port part 600 of the present embodiment is basically configured by a plurality of parts such as the heat insulating spacer 610 in which a contact surface 614 and a non-contact surface 615 are formed, the outlet port part 620 (FIG. 3), and an O-ring 630. The contact surface 614 and the non-contact surface 615 are described hereinafter.

In the present embodiment, the heat insulating spacer 610 is disposed in close contact with (fixed to) an outlet port part flange portion 621 formed on an outer peripheral surface of the outlet port part 620, with the O-ring 630 therebetween.

On the other hand, an outlet port part step portion 623 formed in the outlet port part 620 is a portion used to position the O-ring 630 and the heat insulating spacer 610, so the outlet port part step portion 623 and the heat insulating spacer 610 are preferably disposed with a predetermined gap therebetween.

In the present embodiment, the heat insulating spacer 610 and the outlet port part flange portion 621 function as a heat insulating portion A (FIG. 5) for efficiently transmitting heat (approximately 150° C.), which is obtained from a heater (not shown) disposed below an outlet port part barrel portion 624 of the outlet port part 600, toward the inside of the turbomolecular pump 1 of the outlet port part 600 (the back side of the outlet port 6). It should be note that the outlet port part barrel portion 624 configures a part of the outlet port part 600 that protrudes toward the atmosphere side when the outlet port part 600 is disposed in the turbomolecular pump 1.

As shown in FIG. 3, the outlet port part 620 is configured by an outlet port part atmosphere-side portion 620*a* that protrudes from the turbomolecular pump 1 toward the atmosphere side when the outlet port part 620 is disposed in the turbomolecular pump 1, and an outlet port part vacuum-side portion 620*b* provided internally on the vacuum side.

The outlet port part atmosphere-side portion 620*a* has the outlet port part barrel portion 624 that is a tip section protruding toward the atmosphere side, the outlet port part flange portion 621 that continues into the outlet port part barrel portion 624 and has an O-ring depression 622 formed on the side opposite to the outlet port part barrel portion 624, and the outlet port part step portion 623 for connecting the outlet port part barrel portion 624 and an outlet port part barrel portion 625 to each other via the outlet port part flange portion 621.

(Heat Insulating Spacer)

FIG. 4A is a cross-sectional diagram of the heat insulating spacer 610 taken along the axial direction, and FIG. 4B is a diagram in which the heat insulating spacer 610 is viewed from the outlet port 6 (FIG. 1).

As shown in FIGS. 4A and 4B, the heat insulating spacer 610 has a heat insulating spacer flange portion 611 in which bolt holes 613 are formed, the contact surface 614 that comes into contact with the base 3 of the vacuum pump 1, the non-contact surface 615 that does not come into contact with the base 3 of the vacuum pump 1, and a heat insulating spacer barrel portion 612. In the present embodiment, four bolt holes 613 are provided; however, the number of the bolt holes 613 is not limited thereto and can be changed as appropriate.

In the present embodiment, the contact surface 614 and the non-contact surface 615 are formed on the vacuum side of the heat insulating spacer 610, with a level difference between the concentric circles of the contact surface 614 and the non-contact surface 615 of different inner radii. This step functions as a relief for impeding the escape of heat toward the base 3.

According to such configuration, a part of the vacuum side surface of the heat insulating spacer flange portion 611 configures the contact surface 614 where the heat insulating spacer 610 comes into contact with the base 3, and the rest of the same configures the non-contact surface 615 where the non-contact state between the heat insulating spacer 610 and the base 3 is maintained, reducing the contact area. The smaller the contact area between the contact surface 614 and the base 3, the better.

Moreover, in the present embodiment, the non-contact surface 615 is provided on the vacuum side of the heat insulating spacer 610. However, although not shown, the non-contact surface 615 may be provided on, for example, the surface of the base 3 or on the atmosphere side of the heat insulating spacer 610.

Alternatively, the non-contact surface 615 may be provided on a surface of the outlet port part flange portion 621.

Although it is preferred that the heat insulating spacer flange portion 611 be provided with both the contact surface and the non-contact surface with respect to the base 3, the contact surface may be formed in such a manner that the whole vacuum side surface comes into contact with the base 3.

The heat insulating spacer 610 is manufactured from, for example, stainless steel in the present embodiment, but may be manufactured from a material having thermal conductivity lower than that of at least the base 3, such as aluminum.

(O-Ring)

As shown in FIG. 2, according to the present embodiment, the O-ring 630 is disposed in a part of the contact surface between the heat insulating spacer flange portion 611 and the outlet port part flange portion 621.

In the present embodiment, the O-ring 630 is manufactured from VITON™, for example. However, the O-ring 630 is not limited thereto, and may also be made of, for example, resin having thermal conductivity lower than that of the outlet port part 620 in order to achieve a stronger heat insulating effect.

Alternatively, without using the O-ring 630, the heat insulating spacer flange portion 611 and the outlet port part flange portion 621 may be brought into direct contact with each other.

In addition, according to the present embodiment, the O-ring depression 622 in which the O-ring 630 is disposed functions as a relief for impeding the escape of heat toward the base 3.

(Conduction of Heat)

Figure 5:
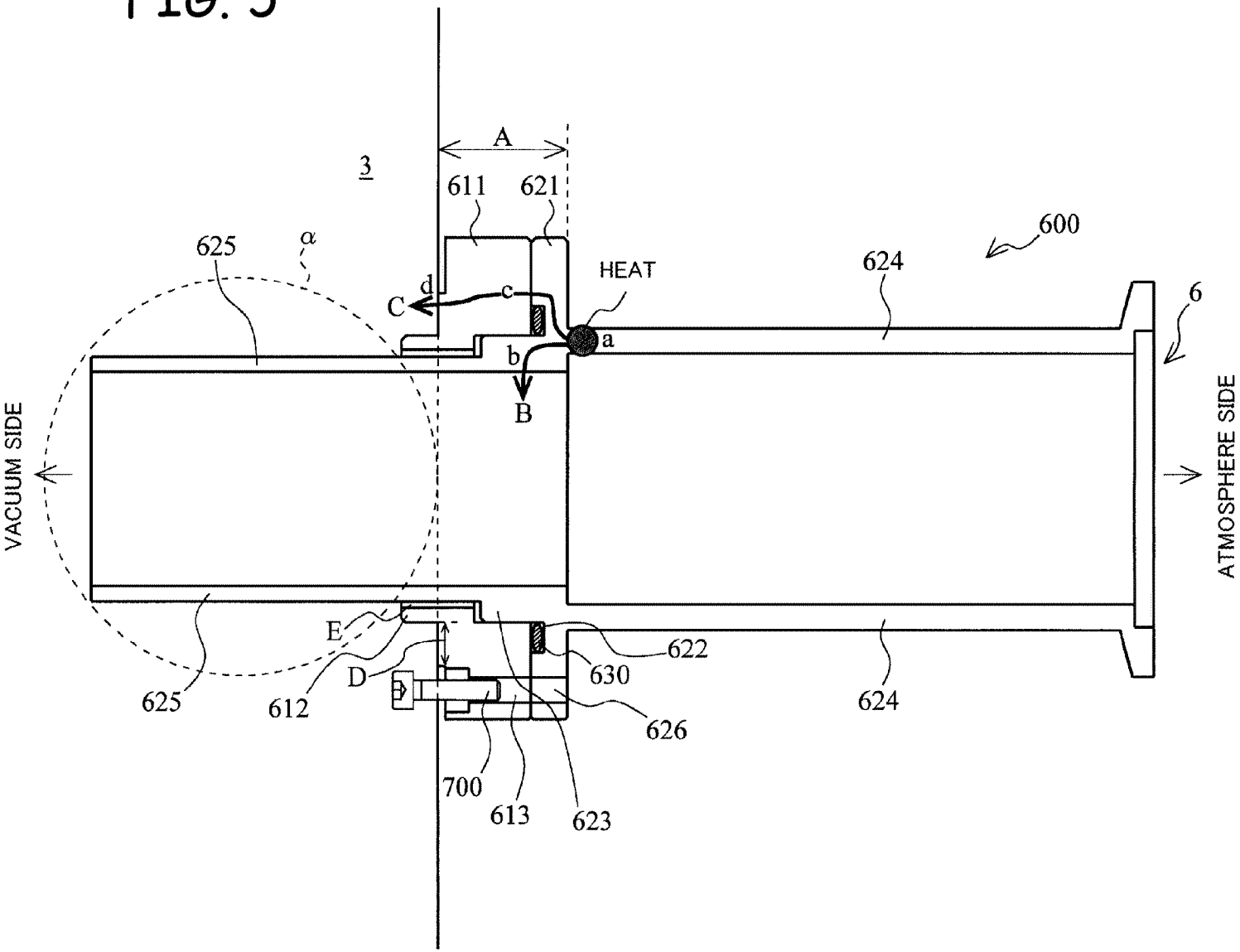
FIG. 5 is a diagram for explaining the outlet port part and heat conduction according to the embodiment of the present invention.

FIG. 5 is a diagram for explaining the conduction of heat in the vicinity of the outlet port of the turbomolecular pump 1 having the outlet port part 600 according to the embodiment of the present invention.

FIG. 5 shows a part of a bolt 700 for fixing the heat insulating spacer 610 and the outlet port part 620 to each other. The bolt 700 is inserted to communicate one of the bolt holes 613 of the heat insulating spacer flange portion 611 and a bolt hole 626 of the outlet port part flange portion 621 with each other, thereby fixing the heat insulating spacer flange portion 611 and the outlet port part flange portion 621 to each other. For the convenience of explanation of the reference numerals, FIG. 5 shows a state prior to communicating the bolt hole 613 and the bolt hole 626 with each other by means of the bolt 700.

In the turbomolecular pump 1 provided with the heat insulating spacer 610 according to the present embodiment, heat of a heater (outlet port heater) wrapped around a lower portion of an atmosphere portion (atmosphere side) of the outlet port part barrel portion 624 is divided by the following two paths and transmitted toward the inside (vacuum side) of the turbomolecular pump 1, as shown in FIG. 5.

(1) path B . . . Heat is transmitted to the inside of the outlet port part 600 and then to the inside of the outlet port 6 (a→b).

(2) path C . . . Heat is transmitted to the base 3 via the outlet port part flange portion 621 (a→c→b).

More specifically, in the outlet port part 600, the heat is (1) conducted from the outlet port part barrel portion 624 (point a) at the atmosphere side to the inside of the outlet port 6 via the outlet port part step portion 623 (point b) or (2) conducted from the point a, to the outlet port part flange portion 621, to the heat insulating spacer flange portion 611 (point c), to the heat insulating spacer barrel portion 612 (point d), and to the base 3.

Incidentally, in the present embodiment, the temperatures at the points (a, b, c, d) are, for example, approximately 150° C. at the point a, approximately 110° C. at the points b and c, and approximately 85° C. at the point d (experimental results).

As described in (1) above, at the point d, the base 3 side on the inside of the outlet port part 600 is kept at approximately 85° C. based on a set temperature (for example) of a pump heater (not shown). Therefore, this influence establishes the environment where the temperatures drop.

According to the present embodiment, the configuration in which the heat insulating spacer 610 is provided between the point a (the outlet port part barrel portion 624) and the base 3, reduces the amount of heat that passes through the path C.

Concretely, compared to the path B, the path C has a longer "heat propagation distance" (heat conduction distance), the distance (length/width) from the point a on the outlet port part barrel portion 624 where the temperature is kept at approximately 150° C. due to the presence of the heater for the outlet port 6 to the point d which is the section (surface) in the heat insulating spacer 610 that is in contact with the base 3. For this reason, more heat passes through the path B than through the path C.

Conversely, because the path C formed has approximately a three times longer heat propagation distance due to the presence of the heat insulating spacer 610 than the path B, which is a normal Hath for heat conduction, more heat acts to pass through the path B having a shorter heat conduction distance. In other words, a structure for preventing the propagation of heat to the base 3 by using the heat insulating spacer 610 (and the O-ring 630) is created.

The present embodiment, as described above, can be configured not to release the heat obtained at the point a (approximately 150° C.) and to reduce the amount of heat that tries to escape to the point c at the branching points b and c (approximately 110° C. at both of the points), to send more heat to the point b. Consequently, the temperature of the outlet port part barrel portion 625 can be increased using the temperature transmitted to the point b. Specifically, the temperature on the vacuum side of the inside of the outlet port 6 can be increased from approximately 85° C. to approximately 110° C.

In addition, according to the present embodiment, a gap E is provided between the heat insulating spacer barrel portion 612 and the outlet port part barrel portion 625 in order not to bring the heat insulating spacer barrel portion 612 and the base 3 into direct contact with each other. This configuration can reduce the area of the contact surface 614 where the heat insulating spacer 610 and the outlet port part barrel portion 625 come into direct contact with each other (see width D).

For instance, the gap E can be formed by making the inner peripheral thick portion of the heat insulating spacer 610 thin.

The size of the gap E is, for example, approximately 1 mm in the present embodiment, but can be changed depending on the environment.

According to the foregoing configuration, the outlet port part 600 according to the embodiment of the present invention and the turbomolecular pump 1 provided with this outlet port part can efficiently transmit, to the inside of the outlet port 6 (the vacuum side, the base 3 side), the heat that is obtained in the installation site for the outlet port heater of the outlet port part 620. As a result, the temperature inside the outlet port 6, especially the temperature of the inner peripheral surface on the vacuum side, can efficiently be increased (can be prevented from dropping), reducing the amount of products accumulated inside the outlet port 6 (the inner peripheral surface, a back portion).

(Modification)

Figure 6:
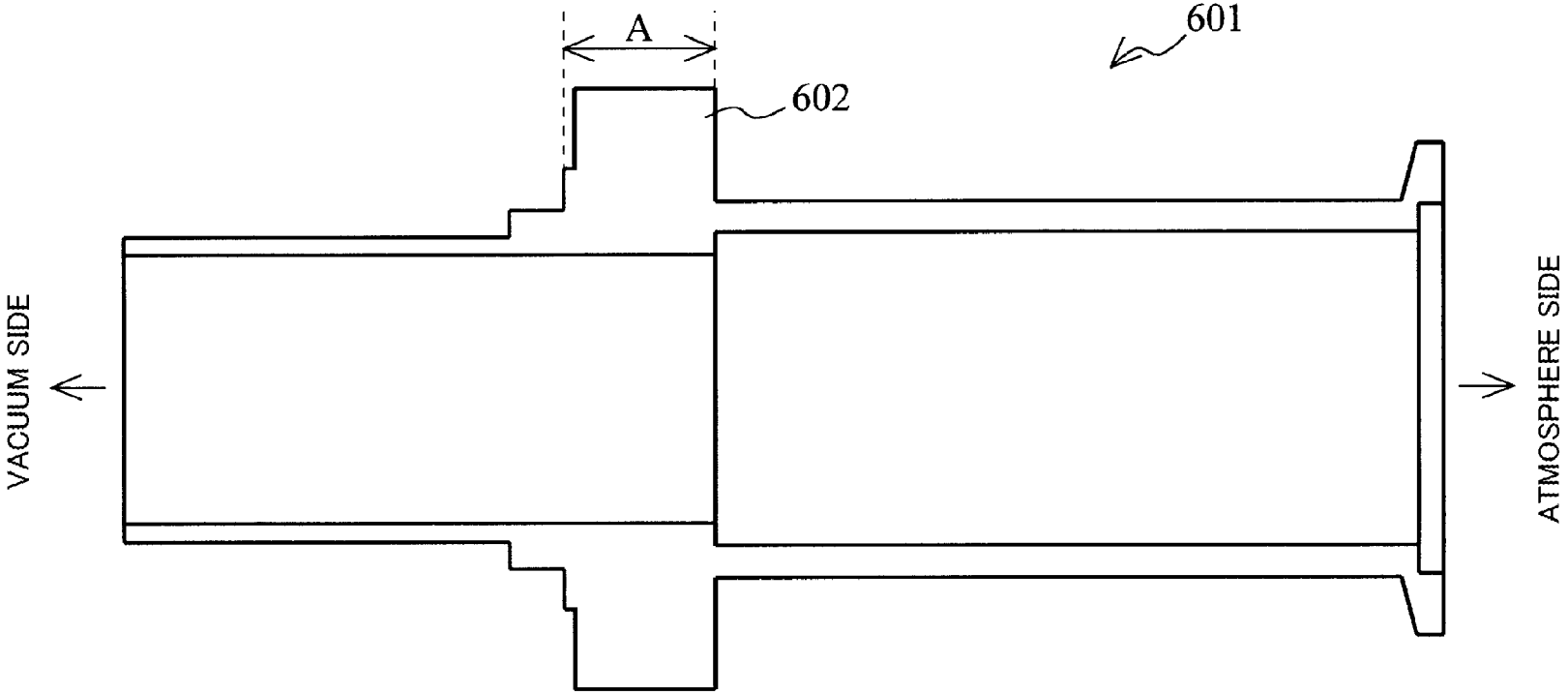
FIG. 6 is a diagram for explaining an outlet port part according to a modification of the embodiment of the present invention.

FIG. 6 is a diagram for explaining an outlet port part 601 according to a modification of the present embodiment.

The outlet port part 600 according to the foregoing embodiment has a plurality of components, but the outlet port part 601 may be configured with a single component, as shown in FIG. 6.

In other words, the outlet port part 601 according to the modification has, in a part of its outer peripheral wall surface, a heat insulating portion 602 (the heat insulating portion A) that is configured by integrating the outlet port part flange portion 621 and the heat insulating spacer 610 of the foregoing embodiment.

In this modification, for example, the heat insulating portion 602 can be formed by making the longitudinal thickness of the outlet port part flange portion 621 (FIG. 3) approximately three times the thickness of the inner peripheral wall.

This heat insulating portion 602 can configure a long heat transmission path.

According to the foregoing configurations, the present embodiment and the modification can efficiently increase the temperature of the entire outlet port 6 (the outlet port parts 600, 601) of the turbomolecular pump 1 by reducing the amount of heat (preventing the heat from being lost to the base 3) that diminishes while moving inward from the outlet port part barrel portion 624 of the outlet port part 600 (601) where the temperature is high due to the presence of the heater (for the outlet port).

As a result, the amount of product and deposit in the vicinity of the outlet port 6 (especially a back portion α of the outlet port part 600: FIG. 5) can be reduced efficiently.

In the present embodiment, the outlet port part barrel portion 625 of the outlet port part 600 (601) is stretched toward the back portion α (FIG. 5) of the outlet port 6 formed in the turbomolecular pump 1.

According to this configuration, the heat obtained from the heater (for the outlet port) is conducted from the outlet port part barrel portion 624 to the farther side (the back portion α) of the outlet port 6 through the outlet port part barrel portion 625. Therefore, the temperature of a wide longitudinal range of the outlet port 6 can be kept high.

As a result, the amount of product and deposit in the back portion α can be reduced.

In the embodiment and modification of the present invention, an example of the vacuum pump provided with the outlet port part 600 (601) is the turbomolecular pump 1, but is not limited thereto.

The present invention may be applied to, for example, a combination pump equipped with a Siegbahn molecular pump portion and a turbomolecular pump portion, a combination pump equipped with a Siegbahn molecular pump portion and a thread groove pump portion, or a combination pump equipped with a Siegbahn molecular pump portion, a turbomolecular pump portion, and a thread groove pump portion.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump comprising:

a housing in which are formed an inlet port and an outlet port;

a rotating shaft contained in the housing and rotatably supported;

a rotating body fixed to the rotating shaft;

a rotor blade provided radially from an outer peripheral surface of the rotating body; and a stator blade disposed at a predetermined interval from the rotor blade;

characterized in that the outlet port comprises a heat insulating spacer, an outlet port part and an O-ring, wherein the outlet port part comprises an outlet port part atmosphere-side portion that protrudes from the vacuum pump toward an atmosphere side when the outlet port part is disposed in the vacuum pump, an outlet port part vacuum-side portion provided internally on a vacuum side an outlet port part step portion positioning the heat insulating spacer, the outlet port part atmosphere-side portion comprises a barrel portion that is a tip section protruding towards the atmosphere side, and a flange portion that continues into the barrel portion, the heat insulating spacer is disposed in close contact with the flange portion with the O-ring therebetween, and the heat insulating spacer has a contact surface that comes into contact with a base of the vacuum pump and a non-contact surface that does not come into contact with the base of the vacuum pump.

2. The vacuum pump according to claim 1, wherein the heat insulating spacer is manufactured from a material having thermal conductivity lower than that of the barrel portion.

3. The vacuum pump according to claim 1, wherein the heat insulating spacer is manufactured from stainless steel.

4. The vacuum pump according to claim 1, wherein a non-contact portion is formed when the heat insulating spacer comes into contact with at least either the flange portion or the base, in order to reduce the area of the contact surface.

* * * * *